US008148884B2

(12) United States Patent
Kakehashi et al.

(10) Patent No.: US 8,148,884 B2
(45) Date of Patent: Apr. 3, 2012

(54) ELECTRODELESS DISCHARGE LAMP

(75) Inventors: Hidenori Kakehashi, Takatsuki (JP); Hiroshi Miyasaki, Tsubame (JP); Keisuke Harada, Himeji (JP)

(73) Assignee: Panasonic Electric Works Co. Ltd., Osaka (JP)

( * ) Notice: Subject to any disclaimer, the term of this patent is extended or adjusted under 35 U.S.C. 154(b) by 912 days.

(21) Appl. No.: 12/064,664

(22) PCT Filed: Sep. 28, 2005

(86) PCT No.: PCT/JP2005/017880

§ 371 (c)(1),
(2), (4) Date: Feb. 25, 2008

(87) PCT Pub. No.: WO2007/023572

PCT Pub. Date: Mar. 1, 2007

(65) Prior Publication Data

US 2010/0066233 A1 Mar. 18, 2010

(30) Foreign Application Priority Data

Aug. 26, 2005 (JP) ..... 2005-246854

(51) Int. Cl.
*H01J 5/20* (2006.01)

(52) U.S. Cl. ..... 313/318.01; 313/318.08; 313/318.09; 313/634

(58) Field of Classification Search ..... 313/331, 313/623–626, 51, 583, 292, 634, 318.01–318.12
See application file for complete search history.

(56) References Cited

U.S. PATENT DOCUMENTS 4,010,400 A 3/1977 Hollister
4,119,889 A 10/1978 Hollister
4,258,287 A * 3/1981 Hetzel ..... 315/58
4,920,297 A 4/1990 Van Der Heijden et al.

(Continued)

FOREIGN PATENT DOCUMENTS

EP 0244025 11/1987

(Continued)

OTHER PUBLICATIONS

English language Abstract of JP 2004-327391.

(Continued)

*Primary Examiner* — Toan Ton
*Assistant Examiner* — Fatima Farokhrooz
(74) *Attorney, Agent, or Firm* — Greenblum & Bernstein, P.L.C.

(57) ABSTRACT

An electrodeless discharge lamp is provided which prevents the problem of decrease in strength due to degradation of resin material, allowing secure fitting of a lamp part and a coupler member to a base even if it is used for a long time. A bulb containing a discharge gas and a coupler member for generating a high frequency electromagnetic field to excite the bulb are detachably fitted to each other via a base for fixing and supporting the bulb. The bulb and the base form a lamp part. The base comprises a base frame formed of a metal such as aluminum and a base cover formed e.g. of synthetic resin. The base frame has a coupler member fitting portion which is provided at a lower part thereof and fitted to the coupler member, wherein bulb fixing posts provided to stand on the coupler member fitting portion fix a bulb outer tube. Thus, the fitting portions of the lamp part and the coupler member to the base undergo less material degradation than a conventional one which uses a base of resin material.

8 Claims, 11 Drawing Sheets

U.S. PATENT DOCUMENTS

| | | | |
|---|---|---|---|
| 5,804,911 | A | 9/1998 | Van Gennip et al. |
| 6,768,254 | B2 | 7/2004 | Arakawa et al. |
| 2003/0210550 | A1 | 11/2003 | Matsuba et al. |
| 2007/0210727 | A1 | 9/2007 | Sun et al. |
| 2007/0262730 | A1 | 11/2007 | Ogasawara et al. |
| 2008/0030143 | A1 | 2/2008 | Goriki et al. |
| 2008/0048586 | A1 | 2/2008 | Hasegawa et al. |
| 2008/0061689 | A1 | 3/2008 | Ohkubo et al. |

FOREIGN PATENT DOCUMENTS

| | | | |
|---|---|---|---|
| JP | 57056911 | * | 4/1982 |
| JP | 59219848 | * | 5/1983 |
| JP | 62-262302 | | 11/1987 |
| JP | 11-508405 | | 7/1999 |
| JP | 2003-31004 | | 1/2003 |
| JP | 2004-327391 | | 11/2004 |
| WO | 95/27995 | | 10/1995 |
| WO | 97/40513 | | 10/1997 |

OTHER PUBLICATIONS

English language Abstract of JP 2003-31004.

* cited by examiner

ELECTRODELESS DISCHARGE LAMP

TECHNICAL FIELD

The present invention relates to a technology to fit a bulb to a coupler member in an electrodeless discharge lamp.

BACKGROUND ART

A conventional electrodeless discharge lamp has no electrode formed inside a light emitting tube, so that in contrast to a general discharge lamp such as a fluorescent lamp, it is free from a lighting failure due to electrode break. Thus, it has the advantage of longer life than a general fluorescent lamp or the like.

As shown in Published Japanese Translation of PCT Application Hei 11-508404, for example, an example of such a known electrodeless discharge lamp fills a discharge gas in a bulb, and applies a high frequency electromagnetic field thereto so as to excite the discharge gas in the bulb for emitting light.

This electrodeless discharge lamp comprises a lamp part as a light emitting body and a coupler member fitted to the lamp part. The lamp part has a bulb containing a discharge gas, and a base which fixes and supports the bulb and which is fitted to the coupler member. The coupler member, which forms an induction coil, has a coil and a heat conductive body for generating electromagnetic energy as well as an attachment member to be fitted to the base. The base and the attachment member of the coupler member are respectively formed of synthetic resin, enabling the lamp part to be attached to and detached from the coupler member, and preventing the lamp part from being easily detached from the coupler member in a state where both are attached to each other.

In this electrodeless discharge lamp, the base and the attachment member of the coupler member are respectively formed of synthetic resin, so that there is a risk that the electrodeless discharge lamp, if used for a long time, may decrease in strength due to degradation of the synthetic resin. Thus, it is considered that it becomes unable to securely fit the lamp part to the base and fit the coupler member to the base in the electrodeless discharge lamp.

DISCLOSURE OF INVENTION

An object of the present invention, to solve the problems of the prior art described above, is to provide an electrodeless discharge lamp which prevents the problem of decrease in strength due to degradation of resin material, allowing secure fitting of the lamp part to the base and of the coupler member to the base in the electrodeless discharge lamp, even if the electrodeless discharge lamp is used for a long time.

According to the present invention, the above-described object is achieved by an electrodeless discharge lamp comprising: a bulb having a discharge container containing a discharge gas inside thereof; a base for fixing and supporting the bulb; and a coupler member detachably fitted via the base to, and for exciting, the bulb, wherein the base comprises a metal frame for fixing the discharge container of the bulb, and a resin cover for covering the metal frame.

According to such structure, the base comprises the metal frame and the resin cover for covering the metal frame, in which the metal frame fixes the discharge container of the bulb. Thus, it undergoes less material degradation than a conventional one which uses a base of resin material, making it possible to securely fix the bulb to the base for a long time. Further, the resin cover has a function of a bulb attaching guide, so that it is possible to protect the gas outlet tube of the bulb when attaching the bulb to the coupler member

BEST MODE FOR CARRAYING OUT THE INVENTION

Figure 1:
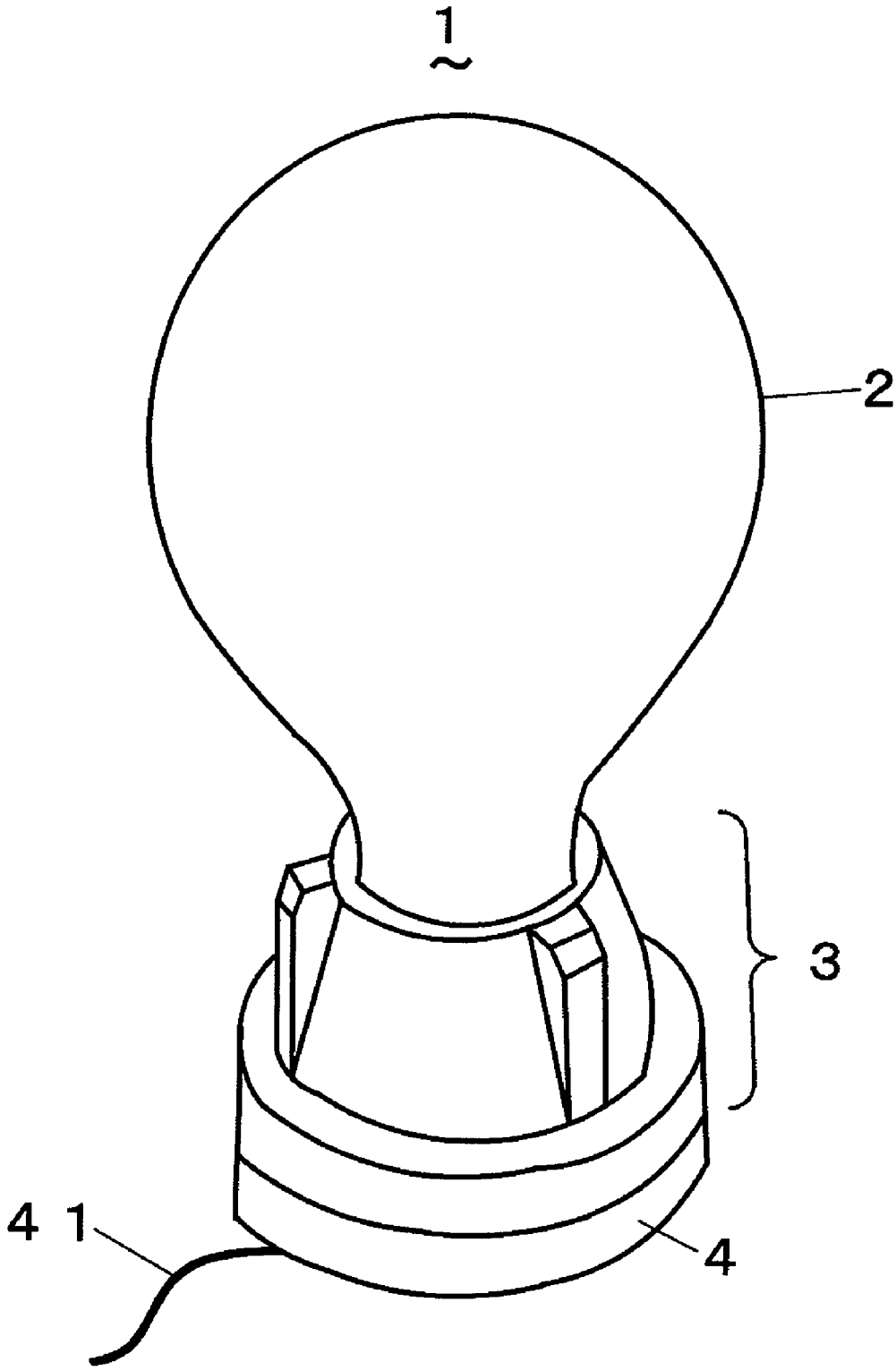
FIG. 1 is an appearance view of an electrodeless discharge lamp according to an embodiment of the present invention.
Figure 2:
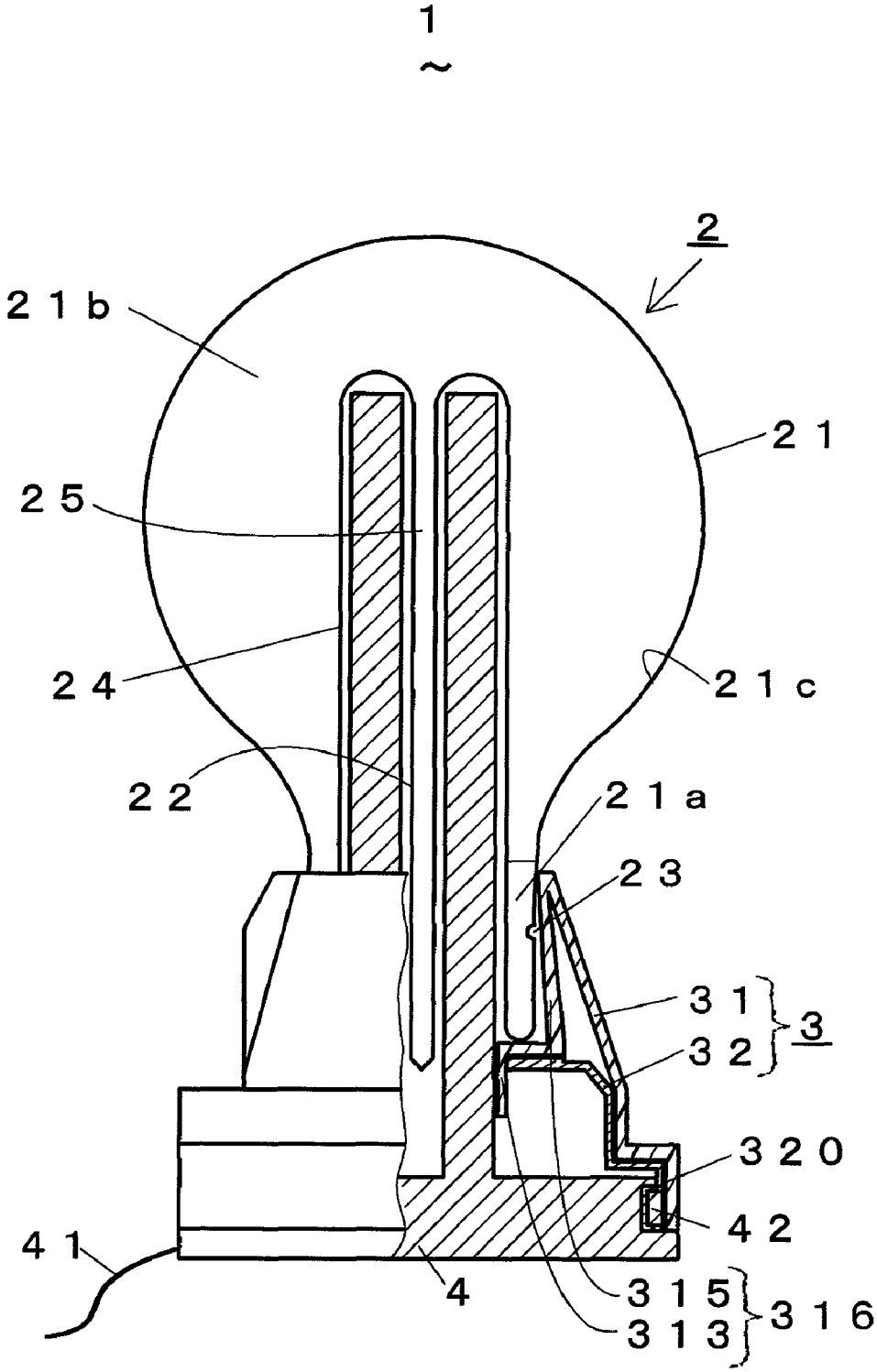
FIG. 2 is a cross-sectional side view of the electrodeless discharge lamp.
Figure 3:
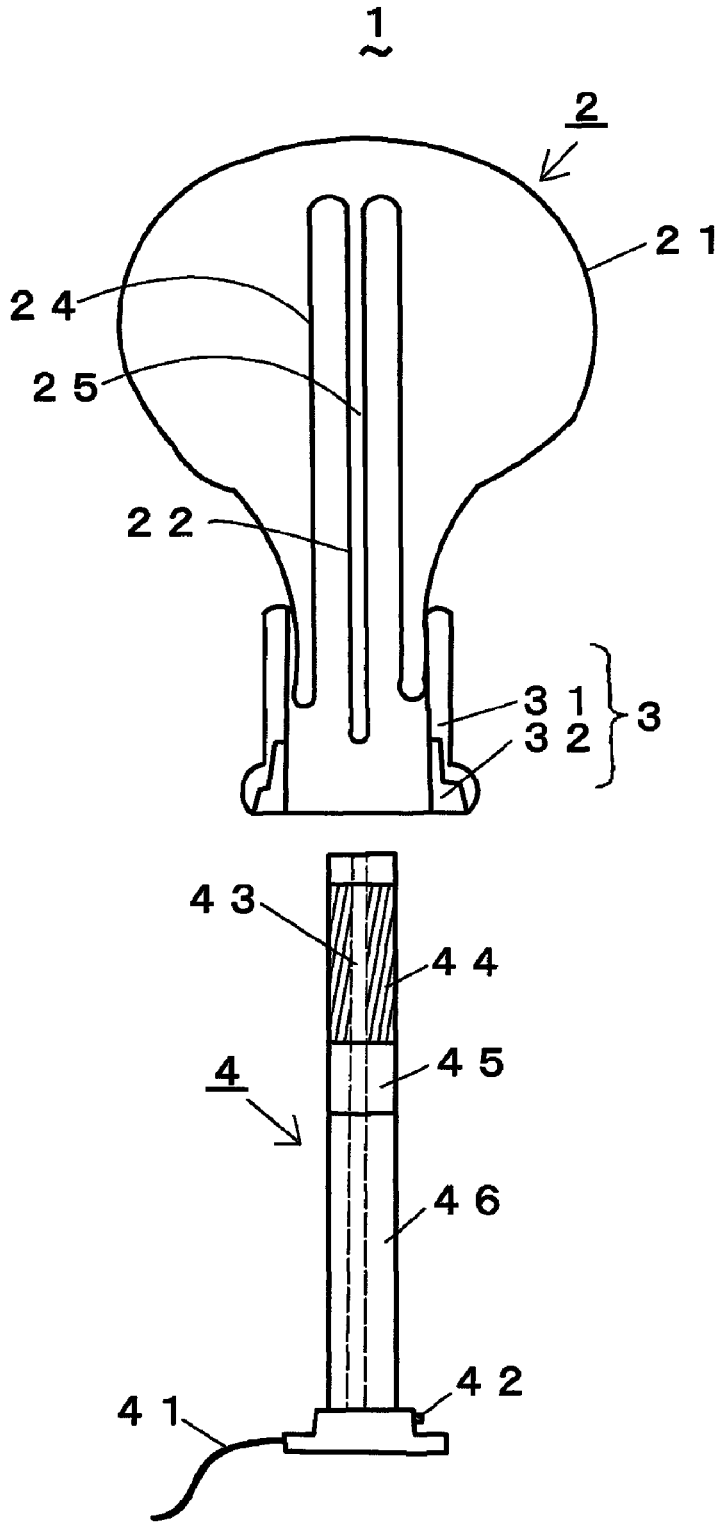
FIG. 3 is a view in an exploded state of the electrodeless discharge lamp.

An embodiment embodying the present invention will be described with reference to the drawings. FIG. 1 shows the entire appearance of an electrodeless discharge lamp, and FIG. 2 shows a cross-sectional side view of the electrodeless discharge lamp, while FIG. 3 shows the electrodeless discharge lamp in an exploded state. This electrodeless discharge lamp 1 comprises: a lamp part having a substantially spherical shaped bulb 2 and a base 3 for fixing and supporting the bulb 2; and a coupler member 4 for generating a high frequency electromagnetic field to excite a discharge gas contained inside the bulb 2, in which the bulb 2 is detachably fitted to the coupler member 4 via the base 3. The bulb 2 has: a bulb outer tube 21 (discharge container); a substantially cylindrical shaped cavity 24 which is provided at a central portion of the bulb outer tube 21 and is provided with a hollow portion 25 formed therein having a substantially circular cross-section; and a gas outlet tube 22 provided at the hollow portion 25 of the cavity 24. The bulb outer tube 21 is formed e.g. of hard glass. A bulb groove 23 (groove) is formed on a periphery of a neck portion 21*a* of the bulb outer tube 21. A fluorescent material is coated on an inner surface 21*c* of the bulb outer tube 21. Air in an inside 21*b* of the bulb outer tube 21 is exhausted through the gas outlet tube 22. Consequently, a discharge gas such as mercury is filled in the inside 21*b* of the bulb outer tube 21.

As shown in FIG. 2, the base 3 comprises a joined body of a base cover 31 (resin cover) formed of a resin such as synthetic resin, and a base frame 32 (metal frame) formed by die-cast molding of a metal such as aluminum, in which they are joined such that the base cover 31 covers the base frame 32. The base cover 31 has a cylindrical shaped portion 316 for attaching the coupler member 4 in axial direction of the bulb 2. This cylindrical shaped portion 316 has: a coupler member attaching guide 313 having a guide function to protect the gas outlet tube 22 when attaching the coupler member 4 to the bulb 2; and a bulb attaching guide 315 having a guide function to protect the gas outlet tube 22 when attaching the bulb 2 to the coupler member 4. The base frame 32 has: a coupler member fitting portion 320 (base portion) provided at a lower part of the base frame 32; and bulb fixing posts provided to stand on the coupler member fitting portion 320 for fixing the bulb outer tube 21. The coupler member fitting portion 320 (base portion) is fitted to the coupler member 4. Details of the base cover 31 and the base frame 32 will be described later.

As shown in FIG. 3, the coupler member 4 has: a cylindrical shaped core 45 with an induction coil 44 wound around a peripheral portion thereof; a column-shaped cylinder 46 formed e.g. of aluminum for exhausting heat of the temperature of the core 45 and having the core 45 fitted and attached to an upper end portion thereof; a hollow portion 43 formed inside the cylinder 46 for accommodating the gas outlet tube 22; a tube lamp cable 41 for supplying high frequency power to the induction coil 44; and base fitting portions 42 to be fitted to the base frame 32 and formed at a lower end portion of the cylinder 46. The core 45, the induction coil 44 and the cylinder 46 each have a substantially circular cross-section, and each have an outer diameter set substantially equal to, and slightly smaller than, an inner diameter of the cavity 24 of the bulb 2. This makes it possible to attach the coupler member 4 to the cavity 24. The base fitting portions 42 are fitted to the coupler member fitting portion 320 of the base frame 32. Details of the base fitting portions 42 will be described later.

When high frequency power is supplied to the tube lamp cable 41 of the coupler member 4, the induction coil 44 generates a high frequency magnetic field. Thus, the discharge gas filled in the inside 21*b* of the bulb outer tube 21 is excited by the energy of the high frequency magnetic field it receives, to discharge and emit ultraviolet light. The emitted ultraviolet light is converted to visible light by the fluorescent material coated on the inner surface 21*c* of the bulb outer tube 21.

Figure 4:
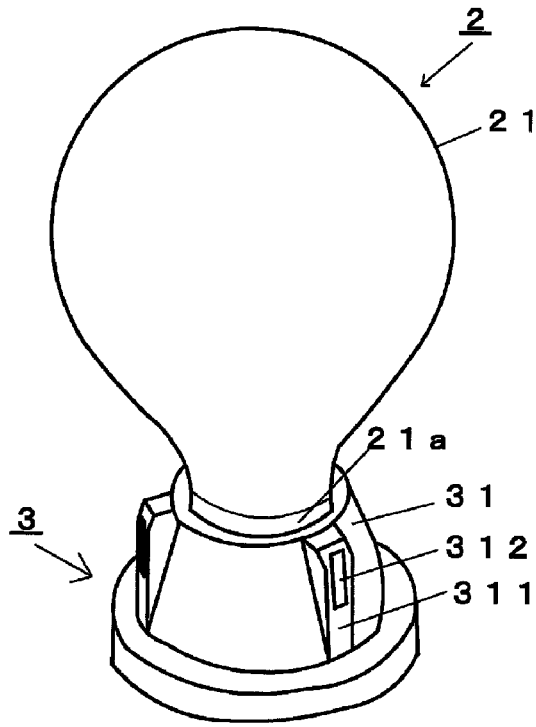
FIG. 4 is an oblique view of a bulb and a base of the electrodeless discharge lamp.
Figure 5:
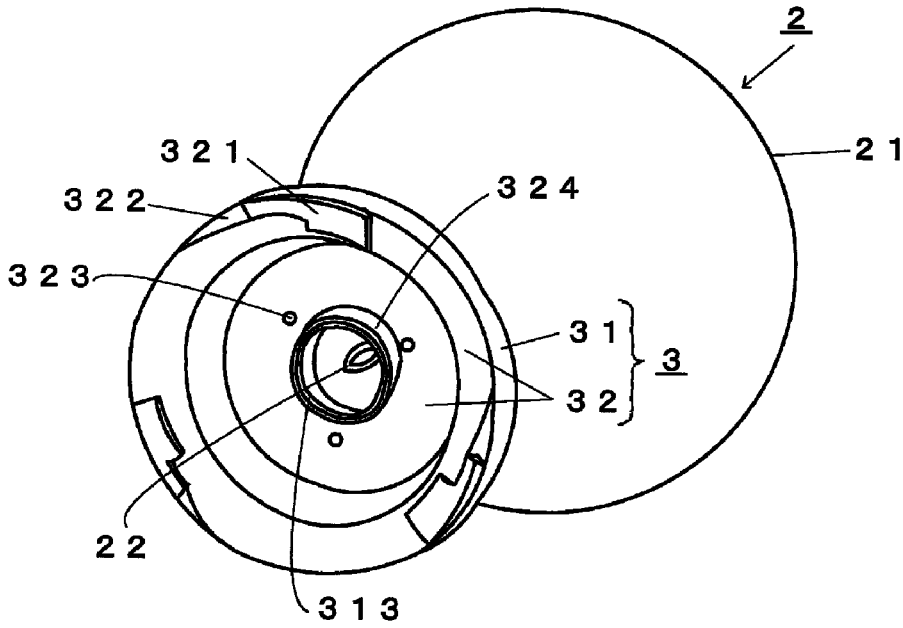
FIG. 5 is an oblique view of the bulb and the base of the electrodeless discharge lamp as seen from below.

Next, referring to FIG. 4 and FIG. 5, the joining of the bulb 2 and the base 3 of the electrodeless discharge lamp 1 will be described. FIG. 4 and FIG. 5 each show an appearance in a state in which the bulb 2 is joined with the base 3. In this joined body, the base cover 31 covers the base frame 32 so as to accommodate it. The neck portion 21*a* of the bulb outer tube 21 is attached to an upper portion of the base cover 31. Thus, the bulb outer tube 21 does not directly contact the base frame 32 which is made of metal, while the base cover 31 is formed of resin so as to be elastic, so that the base cover 31 can reduce impacts to the bulb 2. This makes it possible to reduce the probability that the bulb 2 breaks.

Furthermore, the base cover 31 has formed at an upper portion thereof bulb fixing post covers 311 (post portions of the resin cover) for covering the bulb post portions of the base frame 32. The bulb fixing post covers 311 each have formed therein a stopper mounting hole 312 (hole) passing therethrough into which a later-described stopper for fixing the bulb 2 by being fitted into the bulb groove 23 of the bulb 2 is to be inserted and fitted.

A plurality, here three, of coupler member fixing projections 321 and coupler member fixing grooves 322 to be fitted to the base fitting portions 42 of the coupler member 4 are formed on a periphery of a lower portion of the base frame 32, equidistantly on the circumference. Further, an opening portion 324 is formed at about its center. The coupler member attaching guide 313 of the base cover 31 is fitted into the opening portion 324, while an end of the gas outlet tube 22 is positioned at about the center of the coupler member attaching guide. Further, a plurality of screw holes 323 for inserting screws (not shown) to connect the base frame 32 and the base cover 31 are similarly equidistantly formed around the opening portion 324.

Figure 6:
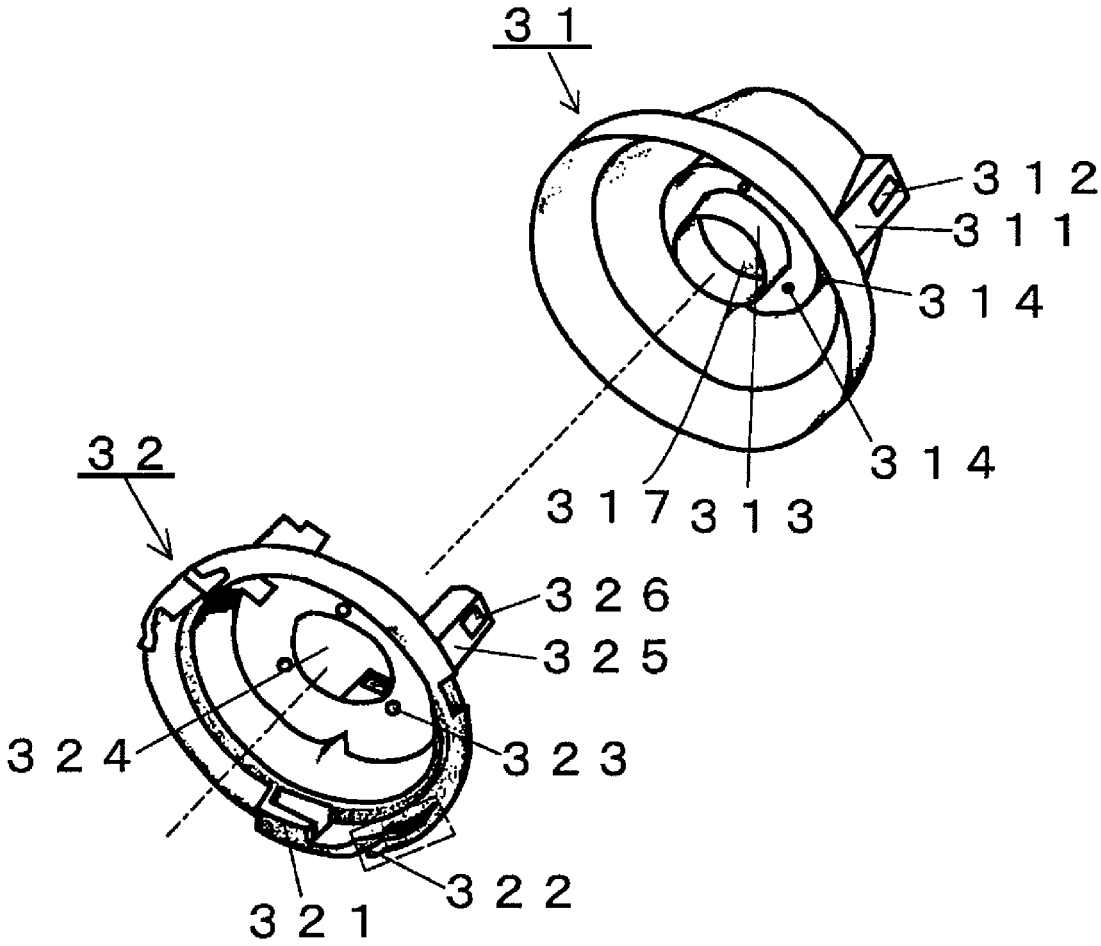
FIG. 6 is an exploded oblique view of a base cover and a base frame of the electrodeless discharge lamp.
Figure 7:
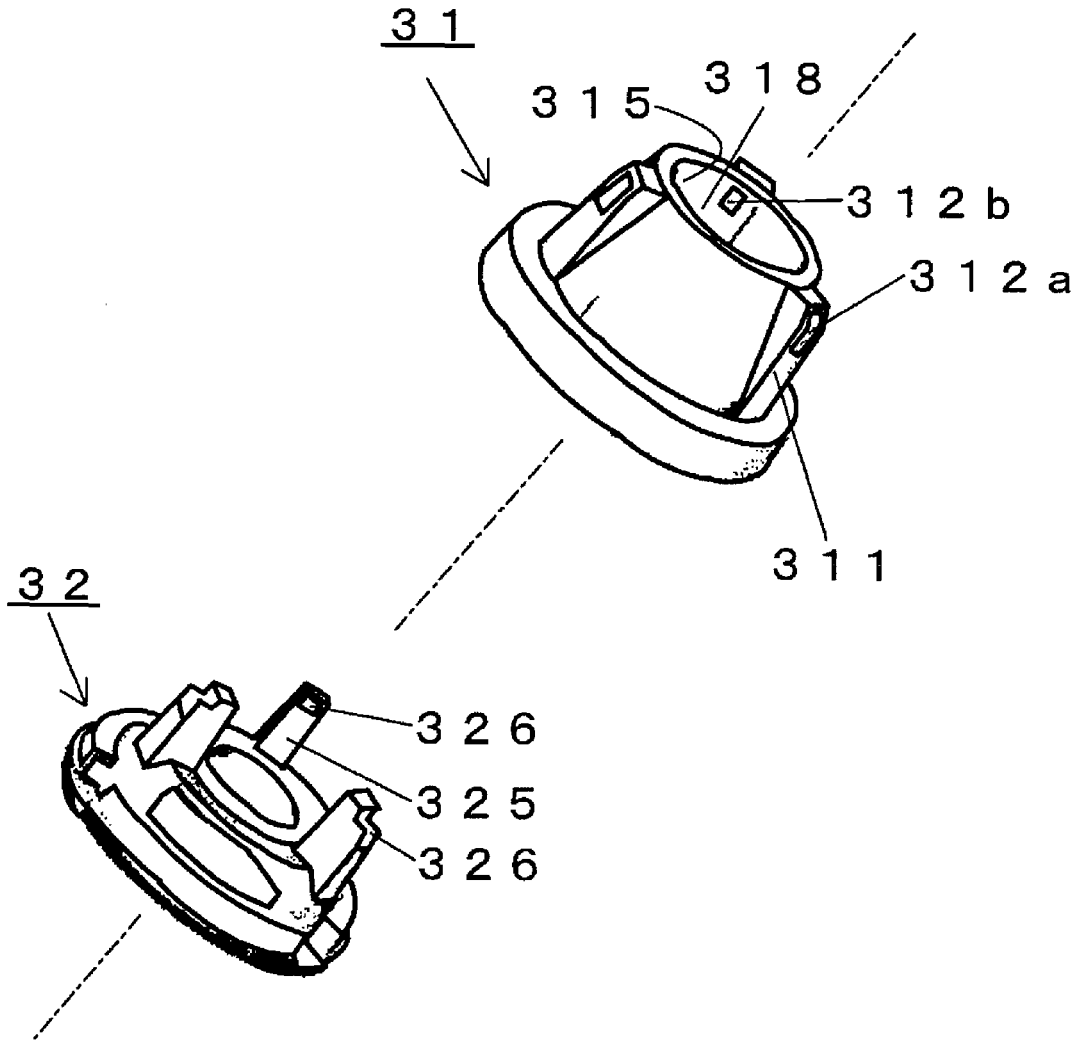
FIG. 7 is an exploded oblique view of the base cover and the base frame of the electrodeless discharge lamp.

Next, referring to FIG. 6 and FIG. 7, the structure of the base cover 31 and the base frame 32 of the electrodeless discharge lamp 1 will be described. FIG. 6 and FIG. 7 each show an appearance of the base cover 31 and the base frame 32. The base frame 32 has a circular opening portion 324 formed at about the center thereof. A plurality of screw holes 323 to be connected to the base cover 31 and a plurality of bulb fixing posts 325 to fix the bulb outer tube 21 are similarly equidistantly formed around the opening portion 324. The base frame 32 is made of metal as described above. Thus, in the bulb 2, the bulb outer tube 21 is fixed by the bulb fixing posts 325 made of metal, so that the strength of the bulb fixing posts 325 is hardly reduced by material degradation. Accordingly, the bulb 2 and the base 3 can be securely fitted for a long time, and at the same time it is possible to reduce the probability that the bulb 2 breaks due to falling of the bulb 2.

The bulb fixing posts 325 of the base frame 32 each have provided at an end thereof a stopper mounting hole 326 (hole) into which a later-described stopper is to be inserted and fitted to fix the bulb 2. U-shaped coupler member fixing projections 321 and coupler member fixing grooves 322 are provided on a periphery of a lower portion of the base frame 32, and are respectively fitted to the base fitting portions 42 of the coupler member 4.

A plurality, here three, of bulb fixing post covers 311 are equidistantly formed on a peripheral side surface of the base cover 31. The bulb fixing post covers 311 each have formed therein a stopper mounting hole 312 (hole) through which a later-described stopper passes. Provided inside the base cover 31 are: a coupler member attaching guide 313 having a through-hole 317 for attaching the coupler member 4 in axial direction of the bulb 2; and a bulb attaching guide 315 also having a through-hole 318 and having a guide function to protect the gas outlet tube 22 when attaching the bulb 2 to the coupler member 4. Further, screw holes 314 into which screws for connection to the base frame are to be inserted and fitted are formed around the coupler member attaching guide 313. In a state in which the base frame 32 is covered by the base cover 31, the screw holes 314 provided in the base cover 31 are placed just above the screw holes 323 provided in the base frame 32, while the bulb fixing post covers 311 cover the bulb fixing posts 325. The stopper mounting holes 326 formed in the base frame 32 and the stopper mounting holes 312 formed in the base cover 31 are positioned in direction facing the bulb groove 23 and perpendicular to the axial direction of the bulb 2.

Figure 8:
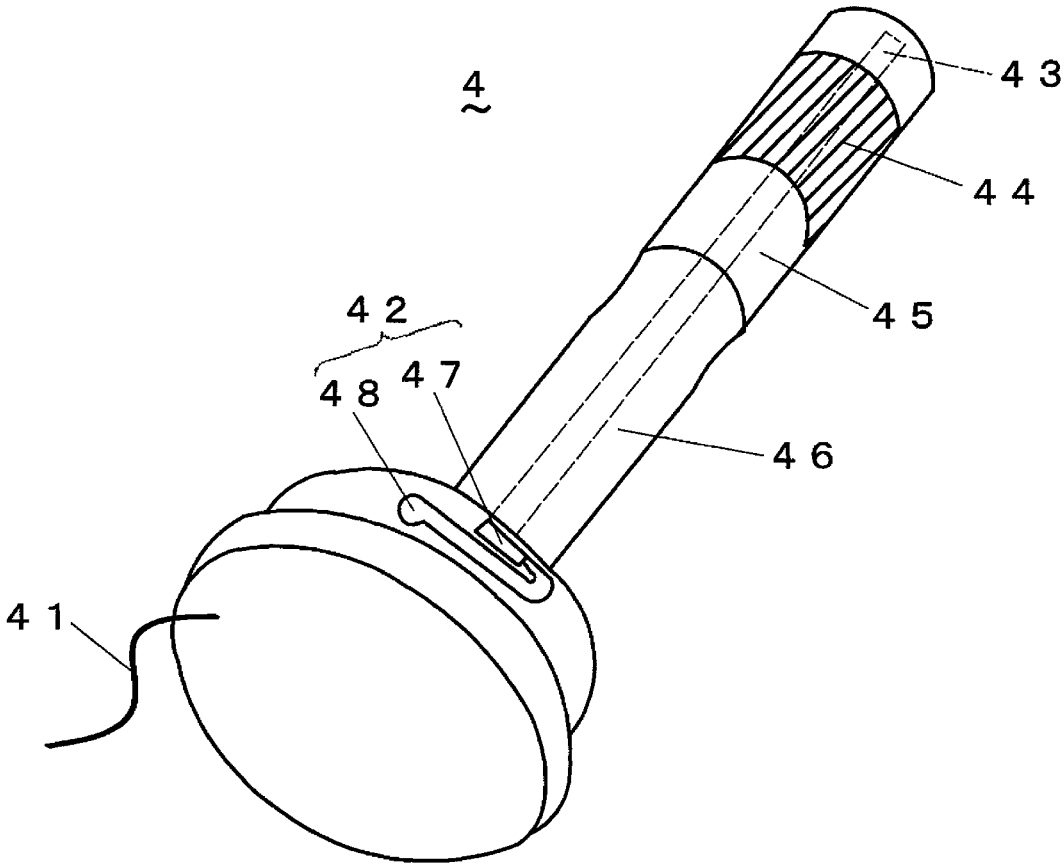
FIG. 8 is an oblique view of a coupler member of the electrodeless discharge lamp.

Next, referring to FIG. 8, the coupler member 4 of the electrodeless discharge lamp 1 will be described. FIG. 8 shows an appearance of the coupler member 4. The coupler 4 has the respective elements 41 to 46 described above and the base fitting portions 42 to be fitted to the base frame 32. The base fitting portions 42 each have a base fixing spring 47 and a base fixing projection 48. The base fixing springs 47 and the base fixing projections 48 are provided on a lower end portion of the cylinder 46, and are respectively formed of metal such as aluminum. The base fixing springs 47 are fitted to the coupler member fixing grooves 322, while the base fixing projections 48 to the coupler member fixing projections 321, respectively, when the coupler member 4, while being rotated, is fitted to the base frame 32. Further, all of the base fixing springs 48, the base fixing projections 48, the coupler member fixing projections 321 and the coupler member fixing grooves 322 are formed of metal as described above. Thus, the strength of the fitting portions is hardly reduced by material degradation, so that the coupler member 4 and the base 3 can be securely fitted to each other for a long time.

Figure 9:
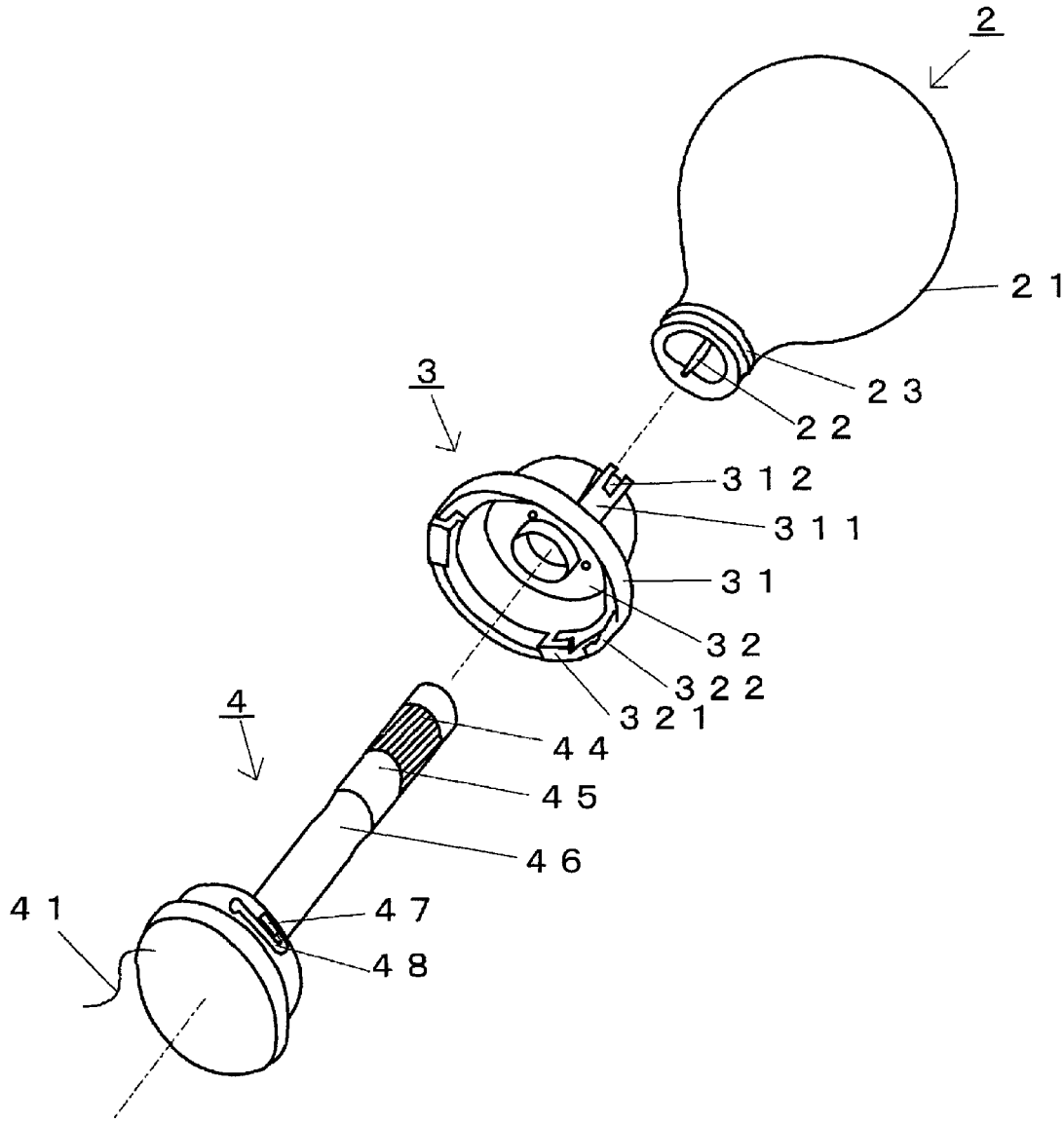
FIG. 9 is an exploded oblique view of the bulb, the base and the coupler member of the electrodeless discharge lamp.

Referring to FIG. 2 to FIG. 9, an assembly of the electrodeless discharge lamp 1 according to the present embodiment will be described. FIG. 9 shows an appearance of the bulb 2, the base 3 and the coupler member 4. First, the base frame 32 is covered with the base cover 31, in which the respective screw holes 314, 323 are secured by screws (not shown), so as to join the base frame 32 with the base cover 31. Subsequently, an adhesive made of resin such as silicone resin is coated around the bulb groove 23 of the neck portion 21*a* of the bulb 2, and the bulb 2 is allowed to pass through the hole 318 of the bulb attaching guide 315 of the base cover 3, and inserted into and bonded to the base cover 31. Thus, the bulb 2 is fixed to the base cover 31. Further, a stopper 5 and a stopper cover 6 as will be described later are attached thereto, whereby the lamp part of the electrodeless discharge lamp 1 is completed. Thus, it is possible to prevent the bulb 2 from falling, and to reduce the probability of the breaking of the bulb 2. Furthermore, since the bulb 2 is allowed to pass through the hole 318 of the bulb attaching guide 315 so as to be attached to the base cover 3, it is possible to reduce the probability of breaking of the gas outlet tube 22.

Next, the coupler member 4 is fitted to the base 3 in the state shown in FIG. 4 and FIG. 5 where the bulb 2 is fitted to the base 3. The coupler member 4 is allowed to pass through the hole 317 of the coupler member attaching guide 313 of the base cover 31, and attached to the cavity 24 of the bulb 2, and further rotated to be fitted to the base 3. Here, the base fixing springs 47, while being rotated, are allowed to mesh with, and thereby be fitted to, the coupler fixing grooves 322, while the base fixing projections 48 are also allowed to similarly mesh with, and thereby be fitted to, the coupler member fixing projections 321. Thus, the electrodeless discharge lamp 1 is completed. Besides, here, the gas outlet tube 22 is accommodated in the hollow portion 43 of the coupler member 4. The coupler attaching guide 313 serves as a guide to attach the coupler member 4 to the bulb 2, so that the gas outlet tube 22 can be securely accommodated in the hollow portion 43 of the coupler member 4.

Figure 10:
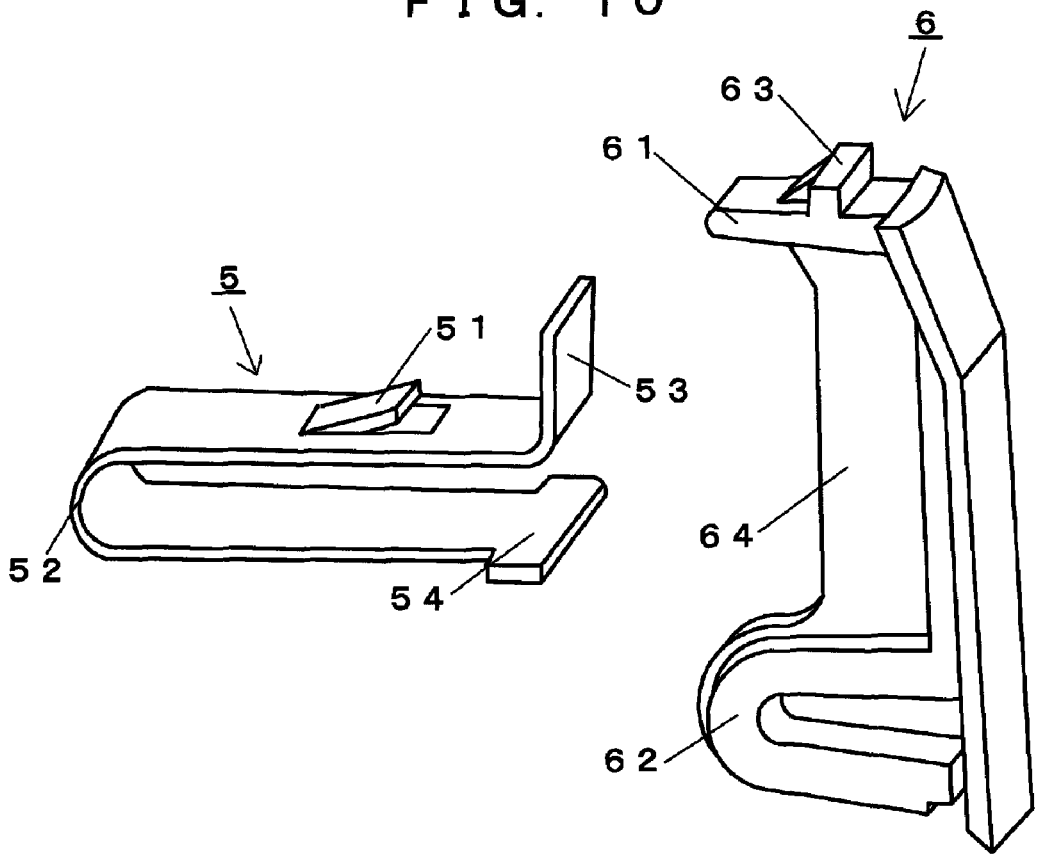
FIG. 10 is a structural view of a stopper and a stopper cover of the electrodeless discharge lamp.
Figure 11:
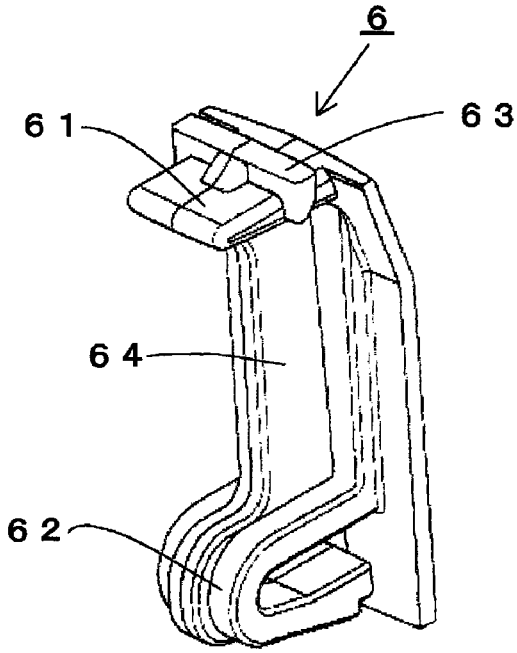
FIG. 11 is a structural view of the stopper cover of the electrodeless discharge lamp.

Next, referring to FIG. 10 and FIG. 11, stoppers (metal pieces) and stopper covers (resin covers) used for the electrodeless discharge lamp 1 will be described. Stoppers 5 are each formed of metal such as stainless steel having a substantially U-shape, in which one end has a vertically bent L-shaped portion 53, while the other end has a large width portion 54 formed with a large width. Its end portion 52 is a U-shaped bent portion. The stopper 5 has formed on an upper portion thereof a hook portion 51 having one end projecting upward from the stopper 5, and having the other end fixed to the stopper 5. On the other hand, stopper covers 6 each have formed on an upper portion thereof a projecting portion 63 extending upward and a projecting portion 61 extending to the end. A semicircular shaped projecting portion 62 is formed on a lower portion of the stopper cover 6. A rib portion 64 is formed between upper and lower ends of the stopper cover 6. The stopper cover 6 is formed e.g. of synthetic resin, and has elasticity.

Figure 12:
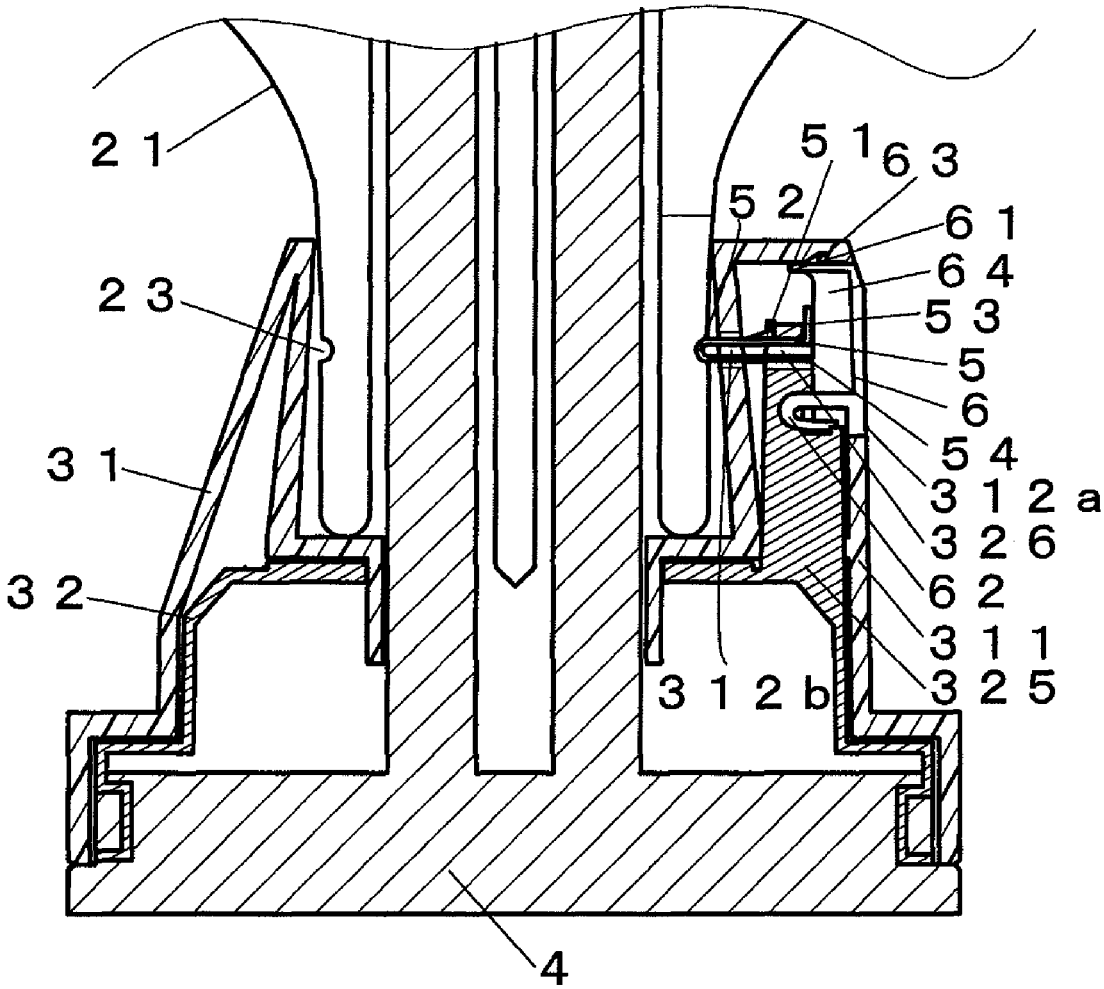
FIG. 12 is an explanatory view showing a state where stoppers and stopper covers are attached to the electrodeless discharge lamp.
Figure 13:
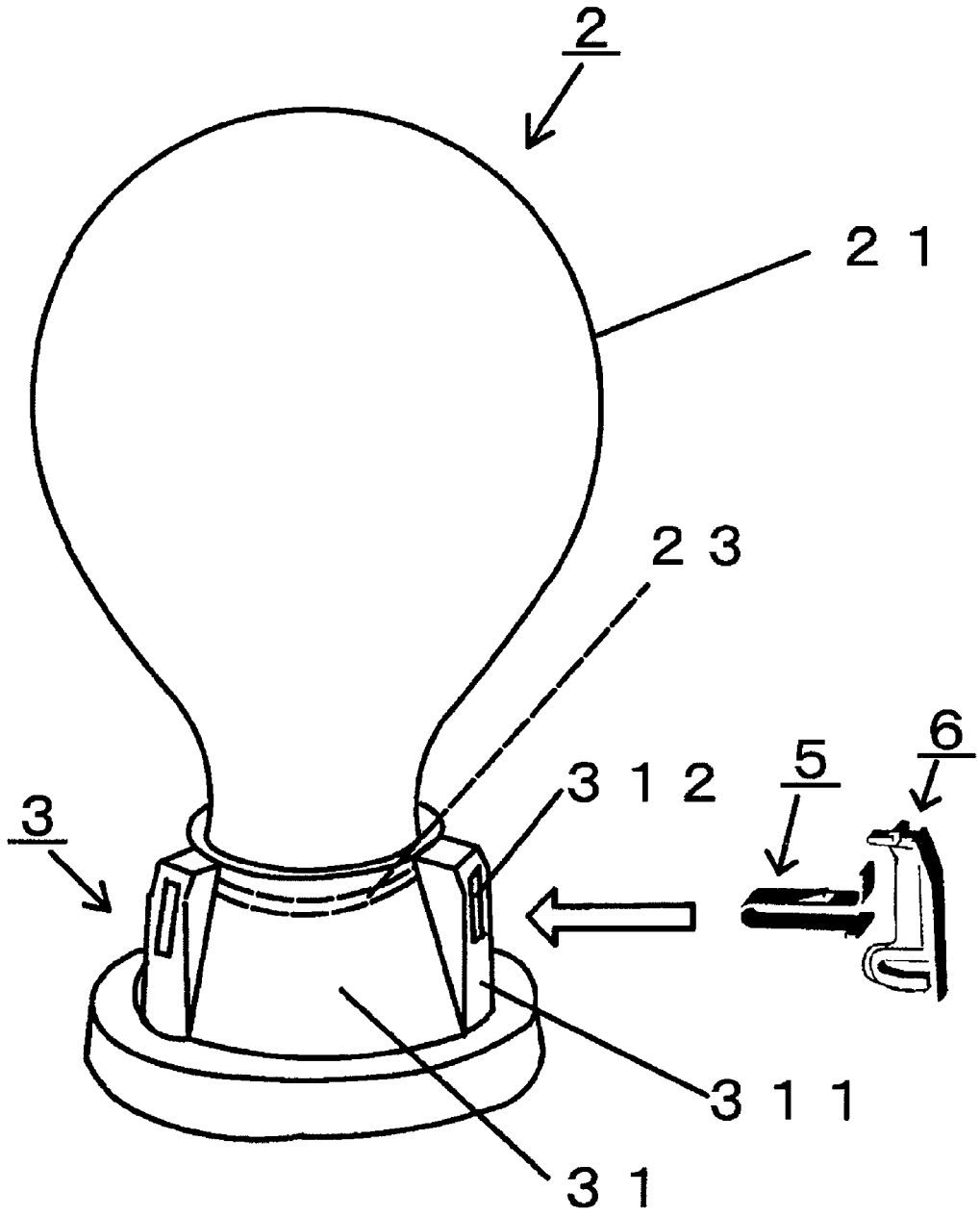
FIG. 13 is an explanatory view in which a stopper and a stopper cover are attached are to be attached to a joined body of the bulb and the base of the electrodeless discharge lamp.

Next, the state in which the stoppers 5 and the stopper covers 6 described above are attached to the electrodeless discharge lamp 1 will be described with reference to FIG. 12 and FIG. 13. The stoppers 5 and the stopper covers 6 are each inserted and attached in direction perpendicular to the axial direction of the bulb 2. The stopper 5 is first passed through a stopper mounting hole 312*a* of the base cover 31, and fitted into a stopper mounting hole 326 formed in a bulb fixing post 325 of the base frame 32, and further fitted into a stopper mounting hole 312*b* of the base cover 31. Here, the end portion 52 of the stopper 5 is fitted into the bulb groove 23, while the hook portion 51 of the stopper 5 is hooked by an end of the bulb fixing post 325. This makes it possible to securely fix the bulb 2 to the base 3 so as to reduce the probability that the bulb 2 breaks due to its falling.

After the fitting of the stopper 5, the stopper cover 6 is fitted into the stopper mounting hole 312*a* of the base cover 31. Here, the semicircular shaped projecting portion 62 of the stopper cover 6 is hooked by an end of the stopper mounting hole 312*a* and an end of the stopper mounting hole 326 of the bulb fixing post 325 by using elasticity, while the projecting portion 61 moves along an inner surface of the base cover 31, and the projecting portion 63 at the upper portion is attached to a recessed portion formed on the inner surface of the base cover 31. Here, the rib portion 64 of the stopper cover 6 is press-contacted with the L-shaped portion 53 and the large width portion 54 of the stopper 5. The stopper mounting hole 312 of the base cover 31 is thereby covered. This prevents e.g. workers from directly contacting the metal stoppers 5. Thus, e.g. the workers can handle the electrodeless discharge lamp 1 safely.

Next, test results of the electrodeless discharge lamp according to the present embodiment will be described. An electrodeless discharge lamp 1 was prepared by attaching a base 3 and a coupler member 4 to a bulb 2 with a sphere diameter of the bulb outer tube of 180 F (sic: 180 mm diameter), a weight of the bulb outer tube of 380 g and a height of the bulb outer tube of 260 mm, and was subjected to vibrations with an acceleration of 10 G As a result, this electrodeless discharge lamp 1 normally emitted light without breaking with the respective elements being securely fitted to each other. Further, it was found from experimental results that the present invention is effective for those which have a weight of the bulb outer tube 21 of over 200 g or have a high-moment joint portion between the bulb 2 and the base 3.

It is to be noted that the electrodeless discharge lamp according to the present invention is not limited to the structure as shown in the embodiment described above, and various modifications are possible as desired within the scope which does not change the spirit the present invention. For example, the base cover 31 and the stopper cover 6 can be formed of white resin so as to increase light reflectance, thereby increasing light extraction efficiency of the electrodeless discharge lamp 1.

In addition, the embodiment described above has shown one in which three of the bulb fixing posts 325, bulb fixing post covers 311 and stopper mounting holes 312, 326 are formed on the circumference, respectively, but it is not limited thereto, and an appropriate number can be used.

This application is based on Japanese patent application 2005-246854, the content of which is to be consequently incorporated into the present invention by reference to the specification and drawings of the above-described patent application.

The present invention has been sufficiently described using presently preferred embodiments with reference to the attached drawings, but it may be obvious to those ordinarily skilled in the art that various alterations and modifications are possible. Accordingly, such alterations and modifications do not depart from the scope of the present invention, and should be interpreted to be included within the scope of the present invention.

The invention claimed is:

1. An electrodeless discharge lamp comprising: a bulb having a discharge container containing a discharge gas inside thereof; a base for fixing and supporting the bulb; and a coupler member detachably fitted via the base to, and for exciting, the bulb, wherein the base comprises a metal frame for fixing the discharge container of the bulb, and a resin cover for covering a portion of the metal frame which portion faces the bulb, the metal frame having a base portion fitted to the coupler member, and post portions provided to stand on the base portion for fixing the discharge container of the bulb, the discharge container having a groove formed near a position where it is fitted to the base, the post portions of the metal frame and post portions of the resin cover which are formed corresponding thereto each having a hole formed at a position facing the groove of the bulb and extending in a direction perpendicular to an axial direction of the bulb, a metal piece that serves as a stopper which has a U-shape for preventing falling of the bulb being fitted into the hole, an end of the metal piece being fitted into the groove of the bulb.

2. The electrodeless discharge lamp according to claim 1, wherein a resin piece for covering the metal piece fitted into the hole is fitted into the hole from outside.

3. The electrodeless discharge lamp according to claim 1, wherein the discharge container of the bulb has a gas outlet tube at about a central portion thereof, wherein the resin cover has a cylindrical shaped portion for attaching the coupler member in an axial direction of the bulb, and wherein the cylindrical shaped portion has a bulb attaching guide for protecting the gas outlet tube when attaching the bulb to the coupler member.

4. The electrodeless discharge lamp according to claim 1 wherein an adhesive is coated around the groove of the bulb so as to bond the bulb to the resin cover facing the groove.

5. The electrodeless discharge lamp according to claim 2, wherein the discharge container of the bulb has a gas outlet tube at about a central portion thereof, wherein the resin cover has a cylindrical shaped portion for attaching the coupler member in an axial direction of the bulb, and wherein the cylindrical shaped portion has a bulb attaching guide for protecting the gas outlet tube when attaching the bulb to the coupler member.

6. The electrodeless discharge lamp according to claim 2, wherein an adhesive is coated around the groove of the bulb so as to bond the bulb to the resin cover facing the groove.

7. The electrodeless discharge lamp according to claim 3, wherein an adhesive is coated around the groove of the bulb so as to bond the bulb to the resin cover facing the groove.

8. The electrodeless discharge lamp according to claim 5, wherein an adhesive is coated around the groove of the bulb so as to bond the bulb to the resin cover facing the groove.

* * * * *

UNITED STATES PATENT AND TRADEMARK OFFICE

CERTIFICATE OF CORRECTION

PATENT NO. : 8,148,884 B2
APPLICATION NO. : 12/064664
DATED : April 3, 2012
INVENTOR(S) : Hidenori Kakehashi et al.

It is certified that error appears in the above-identified patent and that said Letters Patent is hereby corrected as shown below:

Title page, item [73] Assignee "Panasonic Electric Works Co., Ltd., Osaka, (JP)" should be --Panasonic Electric Works Co. Ltd., Osaka (JP) and Ikeda Electric Co., Ltd., Hyogo, (JP)--

Signed and Sealed this
Sixteenth Day of September, 2014

Michelle K. Lee

Michelle K. Lee
*Deputy Director of the United States Patent and Trademark Office*